US006267738B1

(12) United States Patent
Louis

(10) Patent No.: US 6,267,738 B1
(45) Date of Patent: Jul. 31, 2001

(54) MUSCLE THERAPY TOOL

(75) Inventor: John G. Louis, Wilmette, IL (US)

(73) Assignee: AcuForce International, Inc., Winnetka, IL (US)

( * ) Notice: Subject to any disclaimer, the term of this patent is extended or adjusted under 35 U.S.C. 154(b) by 0 days.

(21) Appl. No.: 09/379,028

(22) Filed: Aug. 23, 1999

(51) Int. Cl.[7] ..... A61H 19/00
(52) U.S. Cl. ..... 601/137; 601/118; 601/120
(58) Field of Search ..... 601/15, 72, 73, 601/80, 107, 133, 134, 135, 118, 120

(56) References Cited

U.S. PATENT DOCUMENTS 4,173,217 11/1979 Johnston .
4,345,757 * 8/1982 Lovoi .
4,648,387 * 3/1987 Simmons .
4,832,006 * 5/1998 Kirsch et al. .
5,577,995 * 11/1996 Walker et al. .
5,798,188 8/1998 Mukohyama et al. .

* cited by examiner

*Primary Examiner*—Michael A. Brown
*Assistant Examiner*—Lalita M Hamilton

(57) ABSTRACT

A treatment tool and method of using the same are provided for treating soft tissue by the application of pressure to muscles used in various therapeutic techniques such as trigger point, friction, effleurage and muscle stripping. In one embodiment, the present invention comprises a massage tool having a shaft of a predetermined length and one or more ring members associated with the shaft member for providing muscle stripping and other therapy. The massage tool is of a weight sufficient to assist the therapist in delivering therapy. In another embodiment, the present invention comprises a paddle formed in one end of the shaft. In another embodiment, the massage tool of the present invention has a point member formed in a second end of the shaft for providing trigger point and other therapy.

22 Claims, 1 Drawing Sheet

MUSCLE THERAPY TOOL

CROSS-REFERENCE TO RELATED APPLICATIONS

None

STATEMENT REGARDING FEDERALLY SPONSORED RESEARCH OR DEVELOPMENT

Not applicable.

BACKGROUND OF THE INVENTION

This invention relates to a method and tool for providing massage therapy, physical therapy and/or chiropractic therapy. The tool is used to apply pressure to muscles used in various therapeutic techniques such as trigger point, friction, effleurage and muscle stripping. These techniques are foundational to muscle therapy. The apparatus and method of the invention for the treatment of soft tissue injury may be utilized by professional health care providers, massage therapists, and lay people.

In the past, there have been problems and limitations with respect to tools and methods for the treatment of soft tissue injuries including myofascial pain and cumulative trauma disorder, sometimes called repetitive stress injury. The terms myofascial pain, cumulative trauma disorder, repetitive stress injury and soft tissue injury have each been used to refer to muscle, tendon or ligaments having the condition where maximum tissue strength or maximum work strength has been exceeded causing damage resulting in chronic edema.

The treatment tool of this invention is designed to overcome various deficiencies and limitations in prior treatment tools and methods. Once such limitation stems from the fact that muscle therapy is accomplished by applying pressure to the muscle. Accordingly, the provision of continuous therapy requires significant stamina from, and tends to be extremely taxing on the therapist. Because of this, the therapist often suffers from intense muscle strain over the course of time. Most commonly, the therapist suffers from fatigue, and sometimes injury, to his or her hands, wrists and elbows. Moreover, depending upon the stamina of the therapist, such strain may affect the quality of the therapy delivered to the patient. This may also affect the amount of therapy that the therapist can deliver, and in turn, patient satisfaction and hence the likelihood of return clientele. This is a known problem which exists within the industry, and therapists have been known to leave the profession because of it.

Another problem that is associated with known therapy tools is that they often have a tendency to slip out of the therapist's hands. Because the therapist seeks to deliver a high degree of pressure to treat the patient, any tendency of the treatment tool to slip out of the therapist's hands during use exacerbates the risk of injury to the patient and/or therapist.

Another problem that is associated with known therapy tools is that they are typically limited in the types of treatment that can be delivered to the patient. More particularly, such tools are typically directed to trigger point therapy, that is the application of a focused therapy to a limited area of muscle such as by use of a tool having a rounded-end pointer area. Many if not most therapists, however, use at least several treatment techniques, in addition to trigger-point therapy, such as cross-fiber friction and muscle stripping.

There are various tools sold for use in the treatment of muscle therapy. One such tool is sold under the name "Knobble Whole-Body Muscle Massage." The Knobble tool is made of wood and comprises a handle grip portion attached to a tip designed to deliver trigger point therapy. Another such tool designed to deliver trigger point therapy is sold under the name "Dolphin Massager" by R. Haynes Enterprises of Auburn, Calif. This tool is made of plastic and shaped in the form of a dolphin, having fins that are contoured to deliver trigger point therapy. Such tools suffer from various problems and limitations discussed above. For example, such tools do nothing to address the problem of therapist fatigue, nor do they provide a means by which the therapist may gauge the amount of pressure being applied to the subject area of the patient. The therapist must apply a significant amount of force when using these tools to perform trigger point therapy, as the requisite therapeutic pressure must be provided solely by the therapist. Additionally, such tools suffer from a risk of slippage from the therapist's hands upon the application of high pressure. Such tools also suffer from the limitation that they are can not be used to provide means to deliver therapy other than trigger point therapy.

Another known massage tool is sold under the name "Mob-Assager" by Life and Health, Inc. of Newport Beach, Calif. This relatively lightweight tool is made of a pair of relatively soft roller bulb-type members associated with an elongated handle. The handle extends beyond the roller members to thereby provide a grip area for each of the user's hands. Such therapy tools suffer from various problems and limitations such as noted above, including fatigue of the user and failure to provide multiple therapy techniques.

BRIEF SUMMARY OF THE INVENTION

Accordingly, it is an object of one feature of the present invention to provide a therapy tool that reduces the likelihood of therapist fatigue.

It is also an object of another feature of the present invention to provide a therapy tool that does not have a tendency to slip out of the therapist hands when in use.

It is also an object of another feature of the present invention to provide a therapy tool that allows the therapist to deliver various treatment techniques.

The method and apparatus of the present invention are used to provide therapy by the application of pressure to muscles used in various therapeutic techniques such as trigger point, friction, effleurage and muscle stripping. In one embodiment, the present invention comprises a massage tool having a shaft of a predetermined length and one or more ring members associated with the shaft member. While the massage tool is not limited to any specific weight, it is preferably of a weight ranging from about 2 to 12 lbs. In another embodiment, the present invention comprises a paddle formed in one end of the shaft. In another embodiment, the massage tool of the present invention has a point member formed in a second end of the shaft.

These and other advantages and novel features of the present invention, as well as details of an illustrated embodiment thereof, will be more filly understood from the following description and by reference to the drawings.

DETAILED DESCRIPTION OF THE INVENTION

Figure 1:
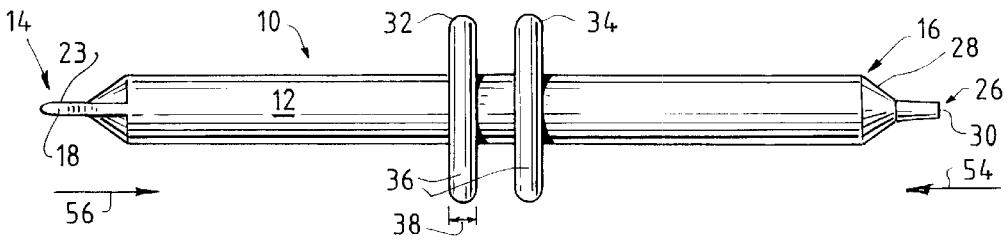
FIG. 1 is front elevational view of a therapy tool of the present invention.

Turning first to FIG. 1, there is shown a treatment tool 10 of the present invention which may be used in the treatment methods of the present invention. The treatment tool 10 is comprised of an elongated shaft 12 that is preferably circular in cross-section. The shaft 10 preferably has a first end treatment end 14 and a second treatment end 16. The shaft 12 is preferably about of a length of about 6 to 16 inches and a diameter of about ½ to 4 inches. It will be understood, however, that the shaft 12 may be longer or shorter in length, and be of a different cross-section, and yet still provide the benefits of the present invention.

Figure 2:
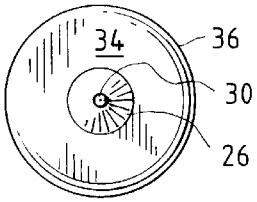
FIG. 2 is an end elevational view of the therapy tool of FIG. 1 in the direction of arrow 54 showing the point member.
Figure 3:
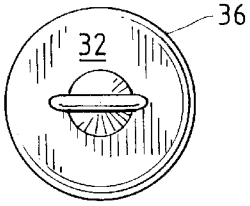
FIG. 3 is a end elevational view of the therapy tool of FIG. 1 in the direction of arrow 56 showing the paddle.

As best shown in FIGS. 1, 2 and 3, a paddle 18 extends from the first treatment end 14 of the shaft 12. The paddle 18 is preferably integral with the shaft 12 and comprises a pair of relatively planar sections 20 that project from the shaft 12 by a smoothly shaped neck 23, to define an elongated treatment edge 22. The treatment edge 22 may be used to provide cross fiber friction, muscle stripping and other therapy to the patient. The treatment edge 22 is preferably of a length 24 that is greater than the diameter of the shaft 12 to facilitate treatment of the patient. In the embodiment shown, the planar sections 20 of the paddle 18 extend about ¾ of an inch from the shaft 12 and the paddle 18 is about ⅜ of an inch in thickness. It is contemplated, however, that the paddle 18 may be sized larger or smaller and contoured of other shapes.

Figure 4:
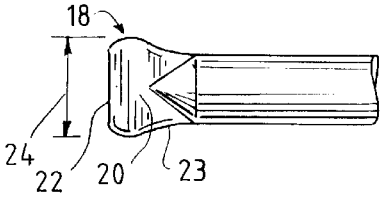
FIG. 4 is a fragmented top view of the paddle member of the therapy tool of FIG. 1.

As shown in FIGS. 1 and 4, a pointer 26 extends from the second treatment end 16 of the shaft 12. The pointer 26 is preferably integral with the shaft 12 and is somewhat conical in shape. More particularly, the pointer 26 is formed from a tapered collar 28 which terminates in a rounded treatment tip 30 having a surface area of about that of the distal portion of a human thumb. The treatment tip 30 is designed to provide pressure to a defined muscle area of a patient for providing trigger point and other therapy. The treatment tip 30 is preferably about ⅝ of an inch in thickness, although it is contemplated that the treatment tip 30 may be larger or smaller, and of different shapes, and yet still be useful in providing muscle therapy.

Turning again to FIG. 1, a first ring member 32 and a second ring 34 are disposed around the shaft 12. The ring members 32 and 34 are preferably of equal size and shape. In the embodiment shown, the ring members have a diameter of about three inches and a thickness (designated reference numeral 38) of about ⅜ of an inch. The outer circumferential surface 36 of each of the ring members 32 and 34 is rounded to provide a smooth treatment surface for contact with the patient (discussed below). The ring members 32 and 34 are preferably spaced from each other along the shaft 12 to accommodate treatment of opposing sides of the patient's spine. As shown, the ring members 32 and 34 are integral to the shaft 12. In an alternate embodiment of the present invention, however, the ring members 32 and 34 are freely rotatable about the shaft 12 by way of a pair of circumferential grooves (not shown) formed in the outer surface of the shaft 12. The ring members 32 and 34 may rotate about the shaft 12 by way of ball bearings (not shown) or other suitable means.

Figure 5:
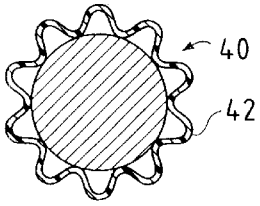
FIG. 5 is a fragmented cross-sectional view of an alternate embodiment of a ring member for use in accordance with the present invention.

Turning now to FIG. 5, there is shown a cross-section of an alternative embodiment of the ring member 40. The ring member 40 has a plurality of nubs 42 formed in the outer circumferential surface of the ring member 40 for providing points of pressure to the patient. As shown, the nubs 42 are preferably equally spaced around the outer circumferential surface of the ring member 40.

The treatment tool 10 is preferably formed of steel by way of a sand cast mold. It will be understood, however, that the treatment tool may be formed of any sturdy material. Suitable materials include any number of metals including brass, iron, stainless steel, or the like, as well as stone or even encased sand or the like. It is preferable that the treatment tool have sufficient weight to facilitate the application of pressure when the treatment tool 10 is used to treat a patient. In this regard, the treatment tool preferably has a weight from about 2 to about 12 lbs. More preferably, the treatment tool has a weight from about 3 to about 10 lbs., and most preferably from about 3 to about 8 lbs. It has been found that this range of weight facilitates the application of pressure to the treatment area of the patient, thereby reducing and/or obviating the need for any additional force that the treatment provider must apply to the patient. In this manner, the treatment tool 10 greatly reduces the likelihood of therapist fatigue. For this same reason, however, it is preferably that the treatment tool 10 not be of an excessive weight, as this would serve to contribute to patient fatigue. In view of the foregoing, the likelihood that the treatment tool 10 will slip out of the hands of the therapist is reduced because the therapist needs only to focus his or her efforts on positioning, rather than applying substantial force to, the treatment tool 10, in order to treat the patient.

Because it is preferably made of metal, the treatment tool 10 may be used as a heat sink, which radiates heat back into the tissue under massage. In this respect, the treatment tool 10 may be pre-heated by hot water or other means before or during use, or the treatment tool 10 may be heated as a result of friction caused by its use against cloth covering the area of the patient being treated. It is also contemplated that a vibrating mechanism may be associated with the treatment tool 10 as a means to facilitate treatment of the patient. One such suitable vibrating mechanism is sold by Homedics corporation under the name "Powerflex."

The treatment tool 10 is preferably coated with plastic or other smooth material, preferably such as sold under the trademark Plastisol by Vynaflex Co. of St. Louis, Mo. This is a very soft and durable material that will protect the sand-cast metal from corrosion and yet be comfortable to touch for both the therapist and patient alike. It also provides a smooth surface for gliding the tool over the patient's skin and works well in conjunction with creams and oils applied to the patient's skin.

The treatment tool 10 can be used to treat a patient by way of various different treatment techniques. First, a therapist can grip the opposing ends of the shaft 12 and move the treatment tool up and down the patient's spine thereby allowing the ring members 32 and 34 to glide over the areas to be treated. This is particularly useful in loosening the back muscles as well other long muscles in the body such as legs and arms. Because the treatment tool 10 is coated with a smooth plastic coating, it glides easily over the patient's skin. The patient may also use ring members 32 and 34 of the treatment tool 10 to provide self-therapy as well.

Second, the therapist (or patient) can use the paddle 18 to provide cross-fiber friction and muscle stripping, two commonly used treatment techniques. This involves, for example, gripping the shaft 12 of the treatment tool 10 and utilizing the paddle 18 to dig into soft tissue to treat otherwise difficult areas to reach. The shape of the paddle 18 and weight of the treatment tool 10 are particularly useful for providing such treatment by facilitating a level of pressure that is high enough to effectively treat inflammation and stimulate nerves in the injury site, with relatively minimal effort on the part of the therapist.

Third, the therapist (or patient) can use the pointer 26 to provide trigger point therapy powerfully and with comparatively nominal effort. This involves, for example, gripping the shaft 12 of the treatment tool 10 and directing the pointer 26 to apply a relatively high degree of pressure directly to a specific treatment area. In this regard, the therapist can easily deliver a high pressure to deep tissue with a treatment surface approximately the area of a human thumb. Moreover, as noted, the weight of the treatment tool 10 facilitates the use of the treatment tool 10 to provide trigger point therapy without great effort on the part of the therapist, as compared to known treatment tools.

As is evident from the foregoing description, the treatment tool 10 is shaped to fit the natural grip of the user's hands when in use (as to any of the various treatment techniques), so that less strength and effort are needed in treatment in comparison to the known treatment tools such as discussed above. Because of its weight and unique shape and design, the treatment tool 10 reduces the likelihood of slippage out of the user's hands and provides for a variety of treatment techniques. The treatment tool therefore provides an apparatus and method for treating a patient using a high pressure, deep tissue massage with much less effort on the part of the therapist as compared to known devices. Moreover, the treatment tool 10 may be used in the treatment of any soft tissue injury that is externally accessible on the human body.

Figure 6:
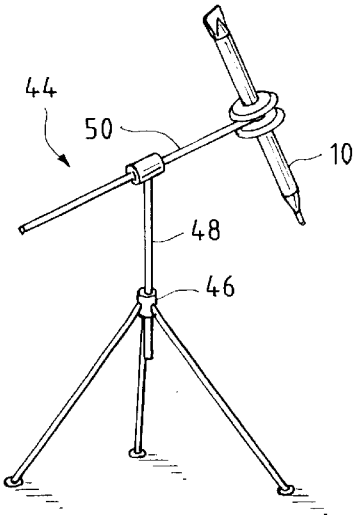
FIG. 6 is a plan view of a stand for use with the treatment tool of the present invention.

Turning now to FIG. 6, there is shown a stand 44 for use with the treatment tool 10 of the present invention. The stand 44 provides a convenient means for storing the treatment tool 10, but also facilitates use of the same. The stand 44 has a tri-pod base 46 from a neck 48 extends. The neck 48 supports an arm 50 that is pivotally associated therewith such as by a grooved fitting (not shown) that is sized to accommodate the cross-section of the arm 50. A bolt (not shown) can be used to hold the arm 50 in place, while allowing the arm to be repositioned to best treat the patient. A grip member that is sized and shaped to hold the shaft of the treatment tool is disposed on one end of the arm 50. The therapist may therefore use the stand 44 to position the treatment tool 10 and, optionally, thereby deliver treatment to the patient by manual movement of the treatment tool 10.

Many modifications and variations of the present invention are possible in light of the above teachings. Thus, it is to be understood that, within the scope of the appended claims, the invention may be practiced otherwise than as described above.

What is claimed is:

1. A massage tool for hand-holdable use comprising:

a shaft member having a predetermined length and having a first end and a second end;

one or more ring members associated with said shaft, wherein said massage tool is of a weight ranging from about 2 to about 12 pounds.

2. The massage tool of claim 1 wherein the shaft member is made of metal.

3. The massage tool of claim 1 wherein the one or more ring members are made of metal.

4. The massage tool of claim 1 wherein the one or more ring members comprise an outer surface having a circular cross-section and further comprise a passage wherein said passage is fixedly associated with said shaft member.

5. The massage tool of claim 1 wherein the one or more ring members have a diameter in the range from ½ to about 5 inches.

6. The massage tool of claim 1 comprising two ring members and wherein two ring members are space about the shaft at a distance to accommodate opposing sides of a human spine.

7. The massage tool of claim 1 comprising two ring members and wherein the first ring member is spaced from the second ring member at a distance of about ½ inch.

8. The massage tool of claim 1 wherein the one or more ring members have an outer surface for contacting a patient's body and wherein the outer surface of the one or more ring members is coated with a smooth material.

9. The massage tool of claim 1 wherein the massage tool is of a weight ranging from about 4 to about 8 pounds.

10. The massage tool of claim 1 wherein the massage tool is of a weight ranging from about 5 to about 7 pounds.

11. A massage tool of claim 1 comprising in addition a paddle member formed in the first end of said shaft members, said paddle member comprising a contoured treatment surface.

12. The massage tool of claim 1 wherein the one or more ring members are integral with said shaft member.

13. The massage tool of claim 11 wherein the paddle is integral with said shaft member.

14. The massage tool of claim 11 wherein the paddle and shaft members are made of metal.

15. The massage tool of claim 11 wherein said massage tool is of a weight ranging from about from 4 to 8 pounds.

16. The massage tool of claim 1 wherein the massage tool is of a weight ranging from about 6 to about 7 pounds.

17. A massage tool of claim 1 comprising in addition a point member associated with said second end of said shaft member.

18. The massage tool of claim 17 wherein the point member has a tip and wherein said tip has a contoured treatment surface comprised of a rounded surface having an inner area and an outer area, said inner area defined in cross-section by a first radii and said outer area defined in cross-section by a second radii, said first radii being larger than said second radii.

19. The massage tool of claim 17 wherein the paddle is integrally formed from said shaft member.

20. The massage tool of claim 17 wherein the point member and shaft members are made of metal.

21. The massage tool of claim 17 having a weight within a range from about 5 to about 8 pounds.

22. The massage tool of claim 17 having a weight within a range from about 6 to about 7 pounds.

* * * * *